US012195924B2

(12) United States Patent
Sakairi et al.

(10) Patent No.: US 12,195,924 B2
(45) Date of Patent: Jan. 14, 2025

(54) MOLDED PULP ARTICLE AND METHOD FOR PRODUCING MOLDED PULP ARTICLE

(71) Applicant: TOPPAN INC., Tokyo (JP)

(72) Inventors: Koji Sakairi, Tokyo (JP); Megumi Ishii, Tokyo (JP)

(73) Assignee: TOPPAN INC., Tokyo (JP)

( * ) Notice: Subject to any disclaimer, the term of this patent is extended or adjusted under 35 U.S.C. 154(b) by 0 days.

(21) Appl. No.: 18/420,148

(22) Filed: Jan. 23, 2024

(65) Prior Publication Data

US 2024/0200275 A1 Jun. 20, 2024

Related U.S. Application Data

(63) Continuation of application No. PCT/JP2022/029667, filed on Aug. 2, 2022.

(30) Foreign Application Priority Data

Aug. 2, 2021 (JP) ..... 2021-126699
Jun. 22, 2022 (JP) ..... 2022-100647

(51) Int. Cl.
*D21J 3/10* (2006.01)
*D21H 21/18* (2006.01)

(52) U.S. Cl.
CPC ..... *D21J 3/10* (2013.01); *D21H 21/18* (2013.01)

(58) Field of Classification Search
CPC ..... D21J 3/10; D21H 21/18
See application file for complete search history.

(56) References Cited

U.S. PATENT DOCUMENTS

2007/0227680 A1 10/2007 Kim et al.
2013/0192780 A1* 8/2013 Parker ..... D21H 17/58 162/146
2020/0063373 A1* 2/2020 Parker ..... D21J 1/08
2020/0385930 A1* 12/2020 Wakabayashi ..... D21H 17/57

FOREIGN PATENT DOCUMENTS

CN 108505372 A 9/2018
JP H11-61700 A 3/1999
JP 2000-303399 A 10/2000
JP 3126714 B2 1/2001
JP 2002-088698 A 3/2002
(Continued)

OTHER PUBLICATIONS

International Searching Authority, "International Search Report," issued in connection with International Patent Application No. PCT/JP2022/029667, dated Oct. 18, 2022.
(Continued)

*Primary Examiner* — Emmanuel S Luk
*Assistant Examiner* — Stephen M Russell
(74) *Attorney, Agent, or Firm* — Foley & Lardner LLP

(57) ABSTRACT

A molded pulp article that has a high strength and allows drying during production to be completed in a short time, having a percentage of fibers having a fiber length of 1 mm or less in pulp is in the range of 15% to 35%, the pulp has an average fiber length in the range of 1.5 mm to 2.5 mm, the molded pulp article has a nitrogen content in the range of 200 μg/g to 1800 μg/g, and the molded pulp article has a thickness in the range of 0.8 mm to 2.0 mm.

20 Claims, 10 Drawing Sheets

(56) References Cited

FOREIGN PATENT DOCUMENTS

| | | | |
|---|---|---|---|
| JP | 2003-129400 | A | 5/2003 |
| JP | 2004-183162 | A | 7/2004 |
| JP | 2008-285188 | A | 11/2008 |
| WO | WO-00/34584 | A1 | 6/2000 |
| WO | WO-2017/200452 | A1 | 11/2017 |

OTHER PUBLICATIONS

International Searching Authority, "Written Opinion," issued in connection with International Patent Application No. PCT/JP2022/029667, dated Oct. 18, 2022.

Wikipedia, "Ultimate tensile strength," retrieved from the internet: https://en.wikipedia.org/w/index.php?title=Ultimate_tensile_strength&oldid=1224154012, last edited on May 16, 2024, retrieved on Jul. 16, 2024, pp. 1-12.

European Partial Supplementary Search Report issued in corresponding European Patent Application No. 22853061.4 dated Nov. 8, 2024.

* cited by examiner

MOLDED PULP ARTICLE AND METHOD FOR PRODUCING MOLDED PULP ARTICLE

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2022/029667, filed on Aug. 2, 2022, which is based upon and claims the benefit to Japanese Patent Application No. 2021-126699 filed on Aug. 2, 2021 and Japanese Patent Application No. 2022-100647 filed on Jun. 22, 2022, the disclosures of which are incorporated herein by reference in their entirety.

TECHNICAL FIELD

The present invention relates to a molded pulp article.

BACKGROUND ART

In recent years, environmental problems related to, for example, an increase in waste have been occurring frequently. In view of this, paper containers are being used instead of plastic containers and metal containers for storing toiletries, drinks, food, and the like. For example, as paper containers for liquids such as milk containers, there are so-called gable top paper containers which are containers made of a paper board coated with polyethylene resin on both surfaces and that have a gable roof-like shape. Such paper containers not only contribute to resource and energy conservation, but also contribute to environmental conservation by being easy to recycle or incinerate when disposed of. Therefore, paper containers have become widespread in various fields.

However, paper containers mentioned above are made by folding and pasting paperboard together; thus, the production process is complicated, and the production costs are high. Further, since the above-described paper containers have a low degree of freedom in shape, there has been a problem in that, for example, the appeal of commercial products based on the container shape cannot be sufficiently exerted.

One of the ways to increase the degree of freedom in the shape of paper containers is pulp molding, which produces molded articles from a slurry containing pulp and water. In pulp molding, generally, the pulp in the slurry is deposited on a paper-making mold to form a pulp layer, and the pulp layer is dehydrated and then dried in a furnace. Molded articles obtained by this technique, that is, molded pulp articles, have excellent heat resistance, cold resistance, moisture absorption and desorption properties, and the like, which are characteristics in terms of physical properties of paper-based packaging materials, and are becoming widely used as paper tray containers for food, fixed cushioning materials for fruits, and the like (PTL 1).

[Citation List] [Patent Literature] PTL 1: JP 2008-285188 A.

SUMMARY OF THE INVENTION

Molded pulp articles preferably have high strength. Further, in the production of molded pulp articles, it is desirable that drying can be completed in a short time.

An object of the present invention is to make it possible to achieve a molded pulp article that has high strength and allows drying during production to be completed in a short time.

According to an aspect of the present invention, there is provided a molded pulp article wherein a percentage of fibers having a fiber length of 1 mm or less in the pulp is in the range of 15% to 35%, the pulp has an average fiber length in the range of 1.5 mm to 2.5 mm, the molded pulp article has a nitrogen content in the range of 200 μg/g to 1800 μg/g, and the molded pulp article has a thickness in the range of 0.8 mm to 2.0 mm.

According to another aspect of the present invention, there is provided a molded pulp article according to the above aspect, wherein a percentage of fibers having a fiber length of 1 mm or less in the pulp is in the range of 25% to 34%, the molded pulp article has a nitrogen content in the range of 300 μg/g to 1000 μg/g, and the molded pulp article has a thickness in the range of 1 mm to 1.5 mm.

According to still another aspect of the present invention, there is provided a molded pulp article according to any of the above aspects, wherein the molded pulp article has a density in the range of 0.6 g/cm$^3$ to 1.2 g/cm$^3$.

According to still another aspect of the present invention, there is provided a molded pulp article according to any of the above aspects, wherein the molded pulp article has a flexural modulus in the range of 1,000 MPa to 3,500 MPa.

According to still another aspect of the present invention, there is provided a molded pulp article according to any of the above aspects, wherein the molded pulp article has a tensile strength in the range of 20 kN/m to 65 kN/m.

According to still another aspect of the present invention, there is provided a molded pulp article according to any of the above aspects, wherein an average ratio of fiber length to fiber width in the pulp is in the range of 80 to 95.

According to still another aspect of the present invention, there is provided a molded pulp article according to any of the above aspects, wherein the molded pulp article has a standard deviation of basis weight is in the range of 2 g/m$^2$ to 45 g/m$^2$.

According to still another aspect of the present invention, there is provided a molded pulp article according to any of the above aspects, wherein the molded pulp article is a container.

According to still another aspect of the present invention, there is provided a method for producing a molded pulp article, including: preparing a slurry containing pulp and water, the pulp having an average fiber length in the range of 1.5 mm to 2.5 mm; depositing the pulp on a paper-making mold having a three-dimensional shape to form a pulp layer; dehydrating the pulp layer to obtain an intermediate molded article; and holding the undried intermediate molded article between male and female molds, and heating the intermediate molded article to a temperature in the range of 130° C. to 200° C. while applying pressure in the range of 0.6 MPa to 6.0 MPa.

According to still another aspect of the present invention, there is provided a method for producing a molded pulp article according to the above aspect, wherein depositing the pulp on the paper-making mold includes: preparing a cover body as a hollow body having an opening; fixing the paper-making mold to the opening; immersing the paper-making mold fixed to the opening in the slurry; and depressurizing a space surrounded by the cover body and the paper-making mold immersed in the slurry.

According to still another aspect of the present invention, there is provided a method for producing a molded pulp article according to the above aspect, wherein the paper-making mold is immersed in the slurry so that the paper-making mold is positioned above the cover body.

According to still another aspect of the present invention, there is provided a method for producing a molded pulp article according to any one of the above aspects, wherein the slurry further contains a paper strength enhancer, the percentage of the paper strength enhancer in the solid content of the slurry is in the range of 0.2 mass % to 3 mass %, the percentage of fibers having a fiber length of 1 mm or less in the pulp is in the range of 25% to 34%, and the pressurization of the undried intermediate molded article held between the male and female molds is performed at a pressure in the range of 1.0 MPa to 3.0 MPa.

The present invention makes it possible to achieve a molded pulp article that has a high strength and allows drying during production to be completed in a short time.

DETAILED DESCRIPTION

Hereinafter, embodiments of the present invention will be described in detail with reference to the drawings. Note that components which have the same or similar functions are given the same reference signs throughout all the drawings, and duplicate description is omitted.

<1> Molded Pulp Article

Figure 1:
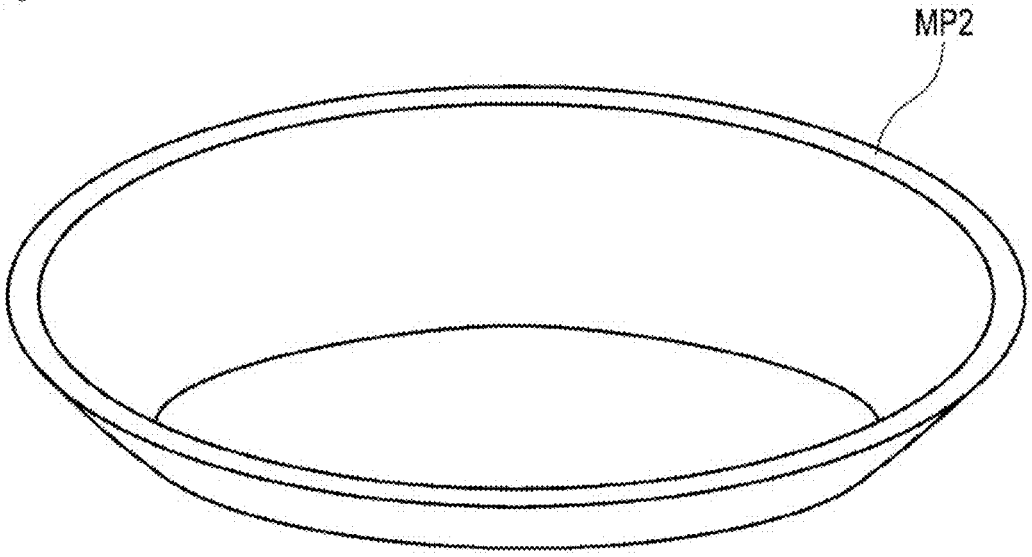
FIG. 1 is a perspective view showing a molded pulp article according to an embodiment of the present invention.

FIG. 1 is a perspective view showing a molded pulp article according to an embodiment of the present invention.

A molded pulp article MP2 shown in FIG. 1 is a container. The molded pulp article MP2 includes a bottom and a sidewall and is open at the top.

The bottom has a disk shape. The orthogonal projection of the bottom on a plane perpendicular to the depth direction of the container may have a shape other than a circle, for example, a polygonal shape such as a rectangular shape.

The sidewall has a cylindrical shape that extends upward from the edge of the bottom. The sidewall expands from the bottom towards the opening. The inner and outer surfaces of the sidewall may be perpendicular to the top surface of the bottom. However, a molded pulp article MP2 of which the sidewall expands from the bottom toward the opening is advantageous in achieving high release properties and is easy to stack.

The molded pulp article MP2 can have various shapes, such as cup, bowl, tray, and box shapes. The molded pulp article MP2 may not be a container as long as it is a three-dimensional molded article, that is, a molded article having a three-dimensional shape rather than an article having a two-dimensional shape, such as a sheet.

The molded pulp article MP2 has a thickness in the range of 0.8 mm to 2.0 mm. That is, in the molded pulp article MP2, the wall thickness, i.e., the thickness of the bottom and sidewall, is in the range of 0.8 mm to 2.0 mm. In the molded pulp article MP2, the thickness is preferably in the range of 1 mm to 1.5 mm, and more preferably in the range of 1.1 mm to 1.5 mm. If the molded pulp article MP2 is thicker, its bending rigidity tends to increase. Such a thick molded pulp article MP2 is bulky particularly when stacked. Moreover, making the walls of the molded pulp article MP2 thinner is advantageous in that drying during production can be completed in a shorter time.

Here, the thickness of the molded pulp article MP2 is a value obtained by the following method. Specifically, five samples are cut out from arbitrary positions in the molded pulp article MP2. Then, the thickness of each sample is measured. For example, a thickness gauge produced by Mitutoyo Corporation may be used for the thickness measurement. The thickness of the molded pulp article MP2 is the average value of measurement results obtained from the five samples.

In the molded pulp article MP2, the percentage of fibers having a fiber length of 1 mm or less in the pulp is in the range of 15% to 35%. This percentage is preferably in the range of 20 to 34%, more preferably in the range of 25% to 34%, and further more preferably in the range of 25% to 32%. If this percentage is small, water vapor easily escapes externally during drying performed in the production of the molded pulp article MP2. Therefore, it is possible to complete drying during production in a short time.

The percentage of fibers having a fiber length of 1 mm or less in the pulp is the ratio of the number of fibers having a fiber length of 1 mm or less to the total number of fibers in the pulp. This percentage is obtained by the following method.

First, 5 g of a sample is obtained from the molded pulp article MP2. Next, the sample is finely shredded, and water is added so that the total mass is 500 g for immersion overnight. Then, the resultant is stirred with a stirrer to defibrate the pulp from each other. In this manner, a dispersion liquid containing pulp is obtained. Next, an appropriate amount is taken from the dispersion liquid, and further diluted with water to prepare a water dispersion liquid with a pulp solid content of 0.05 mass %.

The thus-obtained sample is used to measure the fiber length according to JIS P 8226-2: 2011 "Pulps—Determination of fibre length by automated optical analysis—Part 2: Unpolarized light method." The fiber length measurement is terminated when 20,000 or more fibers with a fiber length of 0.2 mm or more are detected. The percentage of fibers with a fiber length of 1 mm or less in the pulp is determined from the frequency distribution of fiber length obtained by this fiber length measurement.

In the molded pulp article MP2, the percentage of fibers having a fiber length of 0.2 mm or less in the pulp is preferably in the range of 15% to 40%, and more preferably in the range of 30% to 38%. When this percentage is increased, various strengths of the molded pulp article are expected to be improved. However, if this percentage is excessively increased, drying performance during molding may be reduced.

The percentage of fibers having a fiber length of 0.2 mm or less in the pulp is the ratio of the number of fibers having a fiber length of 0.2 mm or less to the total number of fibers in the pulp. This percentage is obtained by the following method.

First, 5 g of a sample is obtained from the molded pulp article MP2. Next, the sample is finely shredded, and water is added so that the total mass is 500 g for immersion overnight. Then, the resultant is stirred with a stirrer to defibrate the pulp from each other. In this manner, a dispersion liquid containing pulp is obtained. Next, an appropriate amount is taken from the dispersion liquid, and further diluted with water to prepare a water dispersion liquid with a pulp solid content of 0.05 mass %.

The thus-obtained sample is used to measure the fiber length according to JIS P 8226-2: 2011 "Pulps—Determination of fibre length by automated optical analysis—Part 2: Unpolarized light method." The fiber length measurement is terminated when 20,000 or more fibers with a fiber length of 0.2 mm or more are detected. The percentage of fibers having a fiber length of 0.2 mm or less in the pulp is determined from the frequency distribution of fiber length obtained by this fiber length measurement.

In the molded pulp article MP2, the average fiber length of the pulp is in the range of 1.5 mm to 2.5 mm. The average fiber length is preferably in the range of 1.5 mm to 2.0 mm, and more preferably in the range of 1.5 mm to 1.8 mm. Increasing the average fiber length decreases the time required for drying during production. However, if the average fiber length is excessively increased, the strength of the molded pulp article MP2 is reduced. The average fiber length is the length-weighted average fiber length LL obtained by measuring the fiber length by the method described above relating to the percentage of fibers having a fiber length of 1 mm or less in the pulp.

In the molded pulp article MP2, the average ratio L/W of fiber length L to fiber width W in the pulp is preferably in the range of 80 to 95, and more preferably in the range of 85 to 92. The average ratio L/W is the ratio Ly/WL of length-weighted average fiber length LL to length-weighted average width WL. The length-weighted average width WL is obtained in the same manner as for the length-weighted average fiber length LL, except that the fiber width is measured in place of the fiber length.

A pulp suspension prepared by dispersing the pulp contained in the molded article MP2 in water preferably has a Canadian Standard Freeness (CSF) of 640 mL or more, and more preferably 650 mL or more. If the Canadian Standard Freeness is lower than this, it tends to take an excessive time to dry the molded pulp article MP2 during production thereof.

The Canadian Standard Freeness is preferably 720 mL or less, and more preferably 680 mL or less. If the Canadian Standard Freeness is higher than this, the molded pulp article MP2 tends to have insufficient strength.

The Canadian Standard Freeness is a value obtained by the following method. First, a sample is obtained from the molded pulp article MP2, and a dispersion liquid containing pulp is obtained in the same manner as described above. Next, the dispersion liquid is diluted with water to a solid content concentration of 0.3 mass % to obtain a water suspension of pulp. Then, 1 L of the suspension is used to carry out measurement specified in JIS P 8121-2: 2012 "Pulps—Determination of drainability—Part 2: Canadian Standard Freeness method." For example, a Canadian Freeness tester produced by Kumagai Riki Kogyo Co., Ltd. is used for this measurement. The measured values are corrected by referring to the previously measured suspension temperature in the correction table. In this manner, the Canadian Standard Freeness is obtained.

It is assumed that the molded pulp article MP2 or an item placed in a container including the molded pulp article MP2 as the main body of the container will be stacked, for example, during transportation and display. The molded pulp article MP2 is required to have strength to avoid buckling deformation in such situations.

In the molded pulp article MP2, the tensile strength is preferably in the range of 20 KN/m to 65 kN/m, more preferably in the range of 25 KN/m to 65 kN/m, and further more preferably in the range of 40 kN/m to 65 kN/m. The tensile strength tends to increase as inter-fiber bonds in the in-plane direction are strengthened. Therefore, increasing the tensile strength can improve buckling strength and breaking strength. However, if the tensile strength is excessively increased, breakage occurs more easily, for example, under conditions where twisting occurs. That is, the molded pulp article MP2 becomes brittle.

In the molded pulp article MP2, the tensile elongation at break is preferably in the range of 5% to 20%, more preferably in the range of 8% to 20%, and even more preferably in the range of 10% to 20%.

The tensile strength and tensile elongation at break are values each obtained in the following manner. First, a strip-shaped sample with a width of 15 mm and a length of 40 mm is cut out from the molded pulp article MP2. Next, the thickness and mass of the sample are measured. Then, the sample is used to carry out the measurement specified in JIS P 8113: 2006 "Paper and board—Determination of tensile properties—Part 2: Constant rate of elongation method." In this measurement, the strip is held so that the distance between grips is 20 mm. The moving speed of the grips, that is, the elongation speed of the sample, is set to 20 mm/min. The tensile strength and tensile elongation at break are each the average value obtained from three measurements.

In the molded pulp article MP2, the peel strength is preferably in the range of 0.01 $N/mm^2$ to 0.9 $N/mm^2$, more preferably in the range of 0.2 $N/mm^2$ to 0.9 $N/mm^2$, and further more preferably in the range of 0.5 $N/mm^2$ to 0.9 $N/mm^2$. The peel strength tends to increase as inter-fiber bonds in the thickness direction of the molded pulp article MP2, that is, in the direction perpendicular to the surface, are strengthened. If the peel strength is lower, fiber bonds in the thickness direction are weak, and there is a risk of cracking from the inside when bending the molded pulp article P2. Further, if the peel strength is lower, surface peeling is likely to occur when force is applied in a direction parallel to the surface, such as when rubbing. Thus, from the viewpoint of strength, the peel strength is preferably high. However, in order to achieve a peel strength that exceeds the upper limit value, excessive densification is required, which may lead to a decrease in productivity.

The peel strength is a value obtained by the "Internal bond strength test method—Part 1: Z-axis direction tensile test method" described in JAPAN TAPPI 18-1. First, a sample that has a square shape with a side of 25 mm is cut out from the molded pulp article MP2. Next, double-sided adhesive tapes are attached to opposing sides of the sample, and the sample is fixed to upper and lower jigs via these double-sided adhesive tapes. The double-sided adhesive tape used herein may be, for example, Scotch Tape (registered trademark) #400 produced by 3M. These jigs are pressed against each other at a load of 150 kgf, and this state is maintained for 20 seconds. This causes the sample to be pressure-bonded to the jigs. Thereafter, while fixing the position of the lower jig, the upper jig is raised at a speed of 20 mm/min to cause interlayer peeling of the sample, and the maximum load at that time is obtained. The peel strength is the average value obtained from three measurements.

In the molded pulp article MP2, the flexural modulus is preferably in the range of 1000 MPa to 3500 MPa, more preferably in the range of 1500 MPa to 3500 MPa, and even more preferably in the range of 2500 MPa to 3500 MPa. A large flexural modulus can be expected to contribute to improvement of the buckling strength and bending strength of the molded pulp article MP2. If the flexural modulus is reduced, when the content of an item placed in a container including the molded pulp article MP2 as the main body of the container is heavy, the molded pulp article is likely to deform during storage, transportation, and the like. If the flexural modulus is increased, the physical properties may become excessively rigid, increasing the possibility of cracking or other damage when dropped.

The flexural modulus is a value obtained by the following method. First, a strip-shaped sample with a width of 10 mm and a length of 40 mm is cut out from the molded pulp article MP2. Next, the thickness of the sample is measured. Then, the sample is used to carry out the measurement by the three-point bending test device (A method) specified in JIS K 7074: 1988 "Testing Methods for Flexural Properties of Carbon Fiber Reinforced Plastics." In this measurement, the distance between the supports is 30 mm, and the descent speed of the indenter is 2 mm/min. From a bending load-strain curve obtained from this measurement, the slope of the bending load-strain curve is calculated under a bending load in the range of 30 mN to 100 mN, and the flexural modulus is calculated from the slope. The flexural modulus is the average value obtained from three measurements.

In the molded pulp article MP2, the density is preferably in the range of 0.6 to 1.2 g/cm$^3$. The density of the molded pulp article MP2 is preferably in the range of 0.7 to 1.0 g/cm$^3$, and more preferably in the range of 0.8 to 1.0 g/cm$^3$.

The density may affect the strength mentioned above. Further, together with a paper strength enhancer, described later, it can also affect the effects resulting from the use of the paper strength enhancer.

The density is a value obtained by the following method. Specifically, a square or rectangular sample is cut out from a portion of the molded pulp article MP2 where the surface is not curved, and the size, mass, and thickness are measured. The density is calculated from the obtained values.

The molded pulp article MP2 preferably further contains a paper strength enhancer, such as polyacrylamide. The use of a paper strength enhancer can increase the strength of the molded pulp article MP2. Among paper strength enhancers, polyacrylamide is particularly convenient in the production of the molded pulp article MP2.

The molded pulp article MP2 produced using a paper strength enhancer has a higher nitrogen content than a molded pulp article produced without using a paper strength enhancer. The nitrogen content of the molded pulp article MP2 is in the range of 200 μg/g to 1800 μg/g. The nitrogen content is preferably in the range of 300 μg/g to 1800 μg/g, more preferably in the range of 300 μg/g to 1500 μg/g, even more preferably in the range of 300 μg/g to 1000 μg/g, still even more preferably in the range of 500 μg/g to 1000 μg/g, and further more preferably in the range of 650 μg/g to 800 μg/g. The nitrogen content of the molded pulp article MP2 may be in the range of 450 μg/g to 1250 μg/g.

If the nitrogen content of the molded pulp article MP2 is reduced, the strength of the molded pulp article MP2 decreases, and deformation etc. may tend to occur during storage. If the nitrogen content is reduced, container shape retention may decrease when it is used as an item placed in a container. If the nitrogen content is excessively increased, fiber aggregates increase in size, and the strength improvement effect accompanying the increase in nitrogen content reaches a plateau.

The nitrogen content of the molded pulp article MP2 is obtained by the following method. First, two samples are collected from arbitrary positions in the molded pulp article MP2. The mass of each sample is 10 mg. Next, each sample is subjected to measurement by the chemiluminescence method specified in JIS K 2609: 1998 "Crude petroleum and petroleum products—Determination of nitrogen content." This measurement may be performed using, for example, a TN-2100H manufactured by Nittoseiko Analytech Co., Ltd. The nitrogen content is the average value of measurement results obtained from the two samples.

<2> Production Apparatus of Molded Pulp Article

Figure 2:
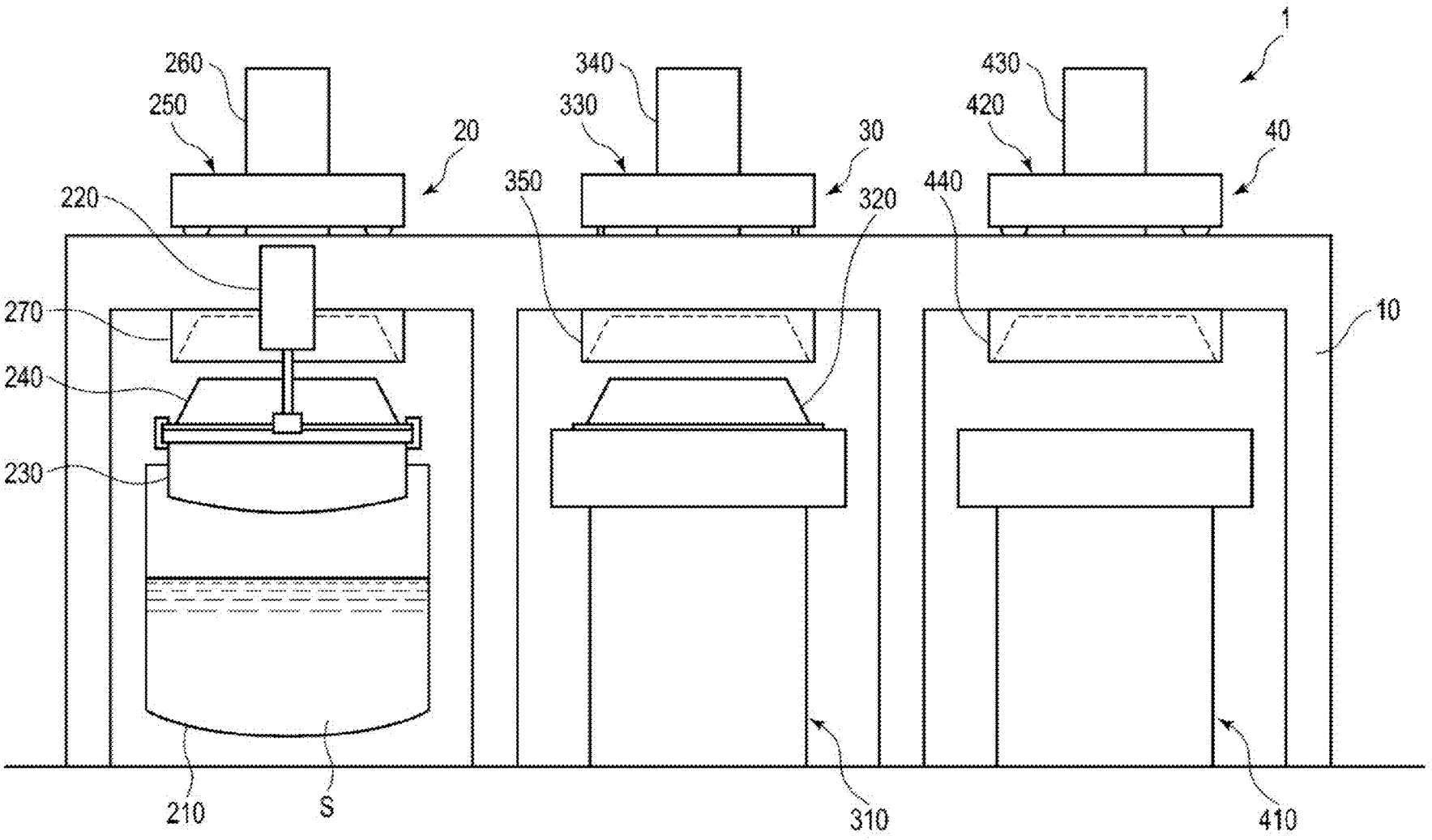
FIG. 2 is a view schematically showing an example of a production apparatus that can be used in the production of the molded pulp article of FIG. 1.

Next, a production apparatus that can be used in the production of the molded pulp article MP2 will be described. FIG. 2 is a view schematically showing an example of the production apparatus that can be used in the production of the molded pulp article of FIG. 1.

A production apparatus 1 shown in FIG. 2 includes a support 10, a first station 20, a second station 30, and a third station 40.

The support 10 includes a frame body and a rail disposed thereon.

The first station includes a container 210, a lifting device 220, a cover body 230, a paper-making mold 240, a conveying device 250, a lifting device 260, and an upper mold 270.

The container 210 is disposed in the frame body of the support 10. The container 210 is open at the top. The container 210 accommodates a slurry S containing pulp and water.

The lifting device 220 is attached to the frame body of the support 10 above the container 210. The lifting device 220 may include, for example, a hydraulic cylinder. The lifting device 220 supports the cover body 230. The lifting device 220 can raise and lower the cover body 230 in the position of the opening of the container 210.

The cover body 230 is a hollow body with an opening on the top. The cover body 230 is connected to a pump, which is not shown.

The paper-making mold 240 is fixed to the opening of the cover body 230. Specifically, the paper-making mold 240 is fixed to the opening of the cover body 230 such that a space adjacent to one surface of the paper-making mold 240 is surrounded by the paper-making mold 240 and the cover body 230.

The paper-making mold 240 is a liquid-permeable mold. The paper-making mold 240 has a three-dimensional shape. That is, the paper-making mold 240 has one or more raised portions and/or one or more recessed portions on the surface on which pulp is deposited. Specifically, the outer surface of the paper-making mold 240, that is, the back side of the side adjacent to the above space, has a shape corresponding to the molded pulp article. Here, the paper-making mold 240 is a male mold with a protruding upper surface.

The paper-making mold 240 may be provided with, for example, many through holes, and includes a paper-making mold body having an outer surface with a shape corresponding to the molded pulp article, and a net body provided on and along the outer surface of the paper-making mold body.

The conveying device 250 can move along the rail of the support 10 between the first station 20 and the second station 30. The conveying device 250 may include, for example, a motor as a power source. The lifting device 260 is attached to the conveying device 250, and can be transported between the first station 20 and the second station 30.

The lifting device 260 is attached to the conveying device 250, as described above. The lifting device 260 may include, for example, a hydraulic cylinder. The lifting device 260 supports the upper mold 270. The lifting device 260 can raise and lower the upper mold 270.

The upper mold 270 is a holder that sandwiches a pulp layer, described later, between the upper mold and the paper-making mold 240, and holds the pulp layer by vacuum suction. The bottom surface of the upper mold 270 has a shape corresponding to the outer surface of the paper-making mold 240. Here, the upper mold 270 is a female mold with a recessed bottom surface. The upper mold 270 may have, for example, one end opening in the bottom surface, and the other end with many through holes connected to a pump.

The second station 30 is provided near the first station 20. The second station 30 includes a stand 310, a lower mold 320, a conveying device 330, a press device 340, and an upper mold 350.

The stand 310 is disposed in the frame body of the support 10. The lower mold 320 is disposed on the stand 310.

The lower mold 320 is a gas- and/or liquid-permeable mold. The top surface of the lower mold 320 has a shape corresponding to the outer surface of the paper-making mold 240. Here, the lower mold 320 is a male mold with a protruding top. The lower mold 320 may have, for example, many through holes and a smooth face with a shape corresponding to the outer surface of the paper-making mold 240.

The conveying device 330 can move along the rail of the support 10 between the second station 30 and a fourth station, not shown. The conveying device 330 may include, for example, a motor as a power source. When the conveying device 330 is located in the second station 30, movement in the vertical, horizontal, and forward/backward directions may be restricted by a locking mechanism. Further, the press device 340 is attached to the conveying device 330, and can be transported between the second station 30 and the fourth station.

The press device 340 is attached to the conveying device 330, as described above. The press device 340 may include, for example, a hydraulic cylinder. The press device 340 supports the upper mold 350. The press device 340 can raise and lower the upper mold 350.

The upper mold 350 is a mold without gas permeability or liquid permeability. The bottom surface of the upper mold 350 has a shape corresponding to the outer surface of the paper-making mold 240. Here, the upper mold 350 is a female mold with a recessed bottom surface. The upper mold 350 has a smooth face with a shape corresponding to the outer surface of the paper-making mold 240.

The second station 30 further includes a heater and a pump (both are not shown). The heater heats both the lower mold 320 and the upper mold 350. The pump is connected to a lower space of the lower mold 320.

The third station 40 is provided near the second station 30. The third station 40 includes a stand 410, a conveying device 420, a lifting device 430, and a holder 440.

The stand 410 is disposed in the frame body of the support 10. A molded pulp article is placed on the stand 410.

The conveying device 420 can move along the rail of the support 10 between the second station 30 and the third station 40. The conveying device 420 may include, for example, a motor as a power source. The lifting device 430 is attached to the conveying device 420, and this can be transported between the second station 30 and the third station 40.

The lifting device 430 is attached to the conveying device 420, as described above. The lifting device 430 may include, for example, a hydraulic cylinder. The lifting device 430 supports the holder 440. The lifting device 430 can raise and lower the holder 440.

The holder 440 is a holder that holds a molded pulp article, described later, by vacuum suction. The bottom surface of the holder 440 has a shape corresponding to the outer surface of the paper-making mold 240. Here, the holder 440 has a recessed bottom surface. The holder 440 may have, for example, one end opening in the bottom surface, and the other end with many through holes connected to a pump.

<3> Method for Producing Molded Pulp Article

In the production method according to an embodiment of the present invention, for example, the production apparatus 1 described above is used to produce a molded pulp article MP2. This will be described with reference to FIG. 1 to FIG. 10.

Figure 3:
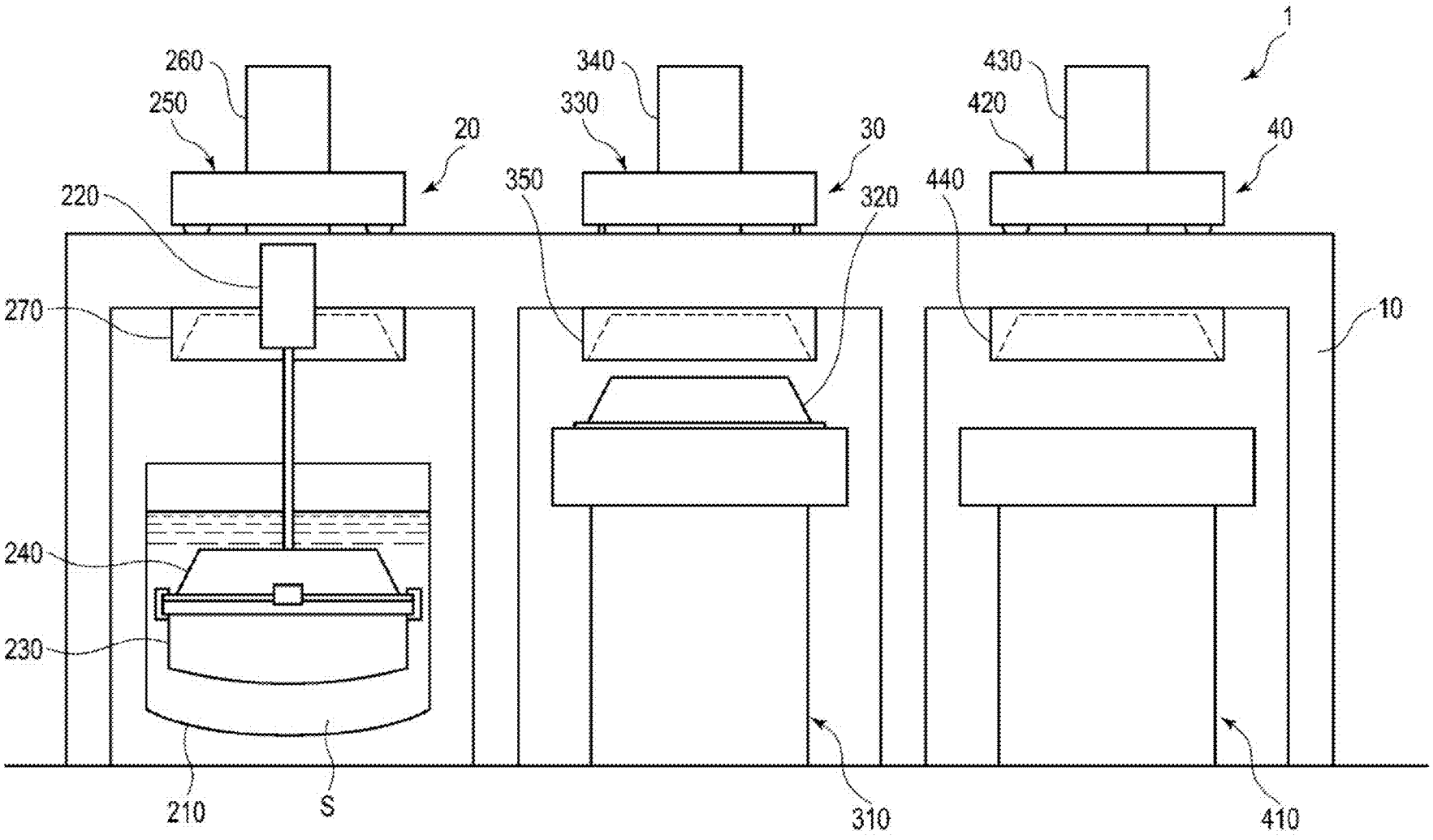
FIG. 3 is a view showing a pulp layer formation step in pulp molding using the apparatus shown in FIG. 2.
Figure 4:
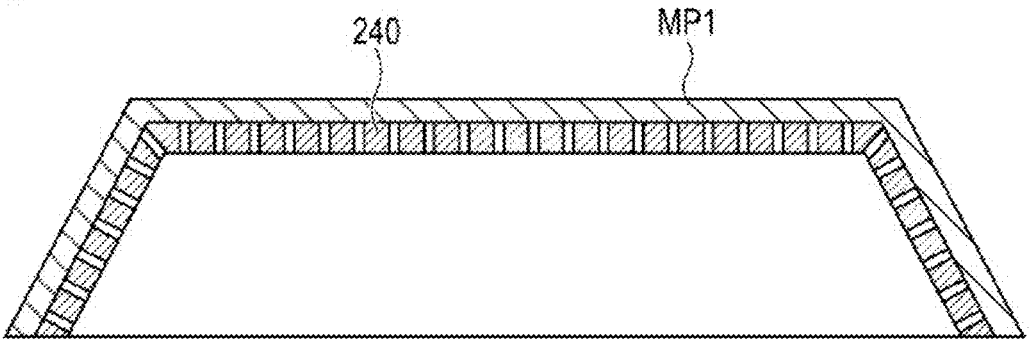
FIG. 4 is a cross-sectional view schematically showing an example of the pulp layer formed on a paper-making mold.
Figure 5:
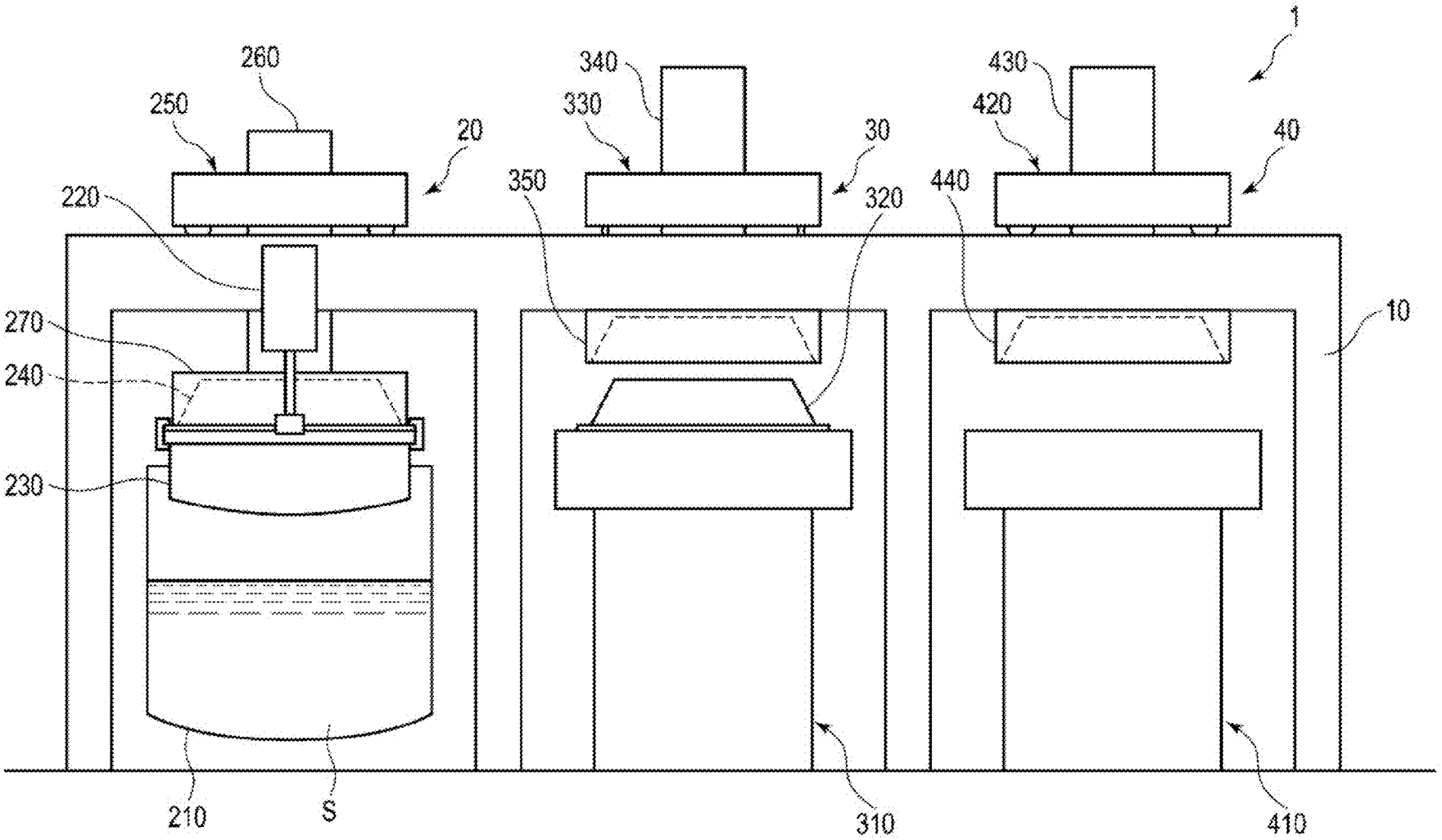
FIG. 5 is a view showing a dehydration step in pulp molding using the apparatus shown in FIG. 2.
Figure 6:
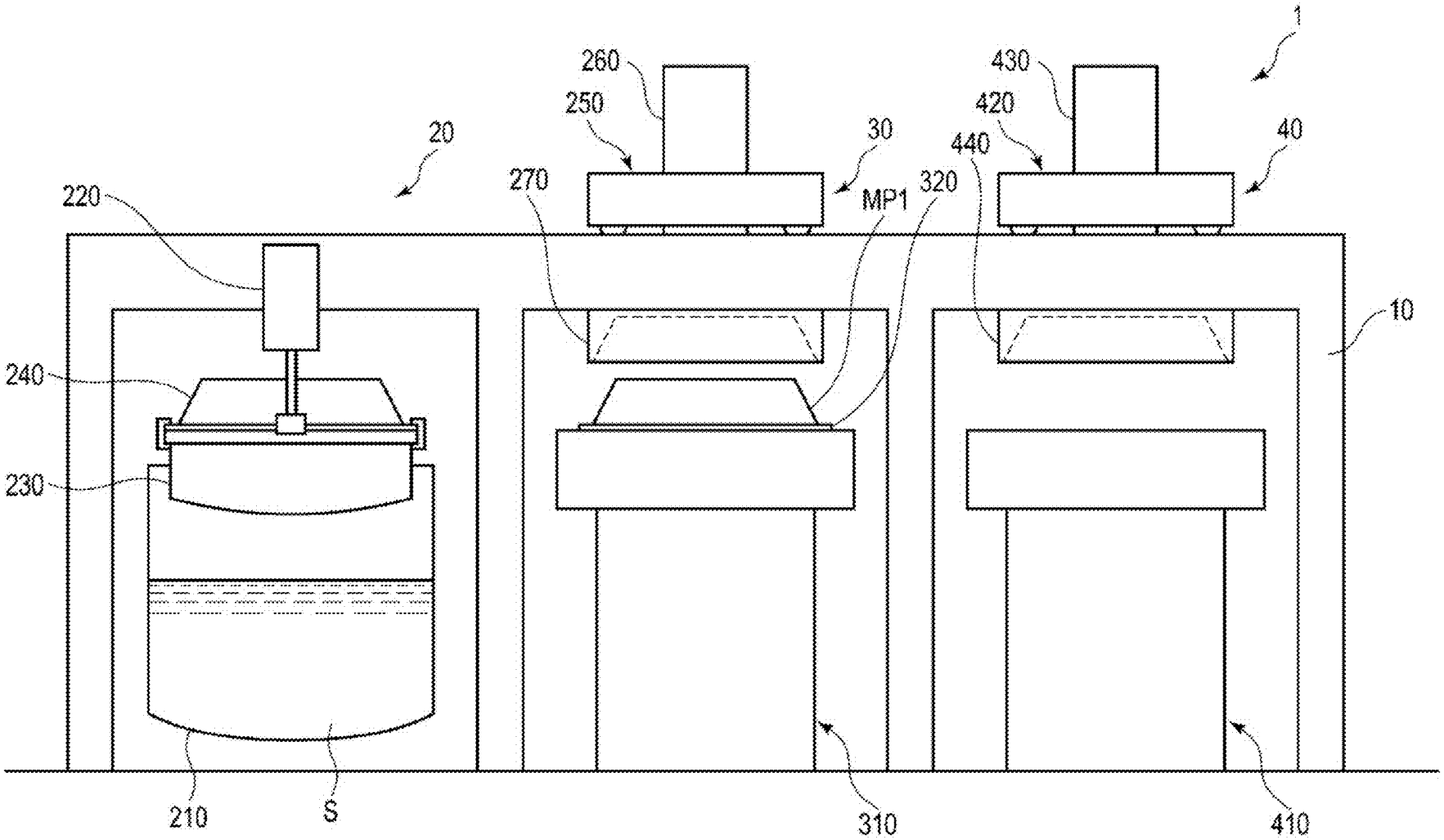
FIG. 6 is a view showing a pulp layer transport step in pulp molding using the device shown in FIG. 2.
Figure 7:
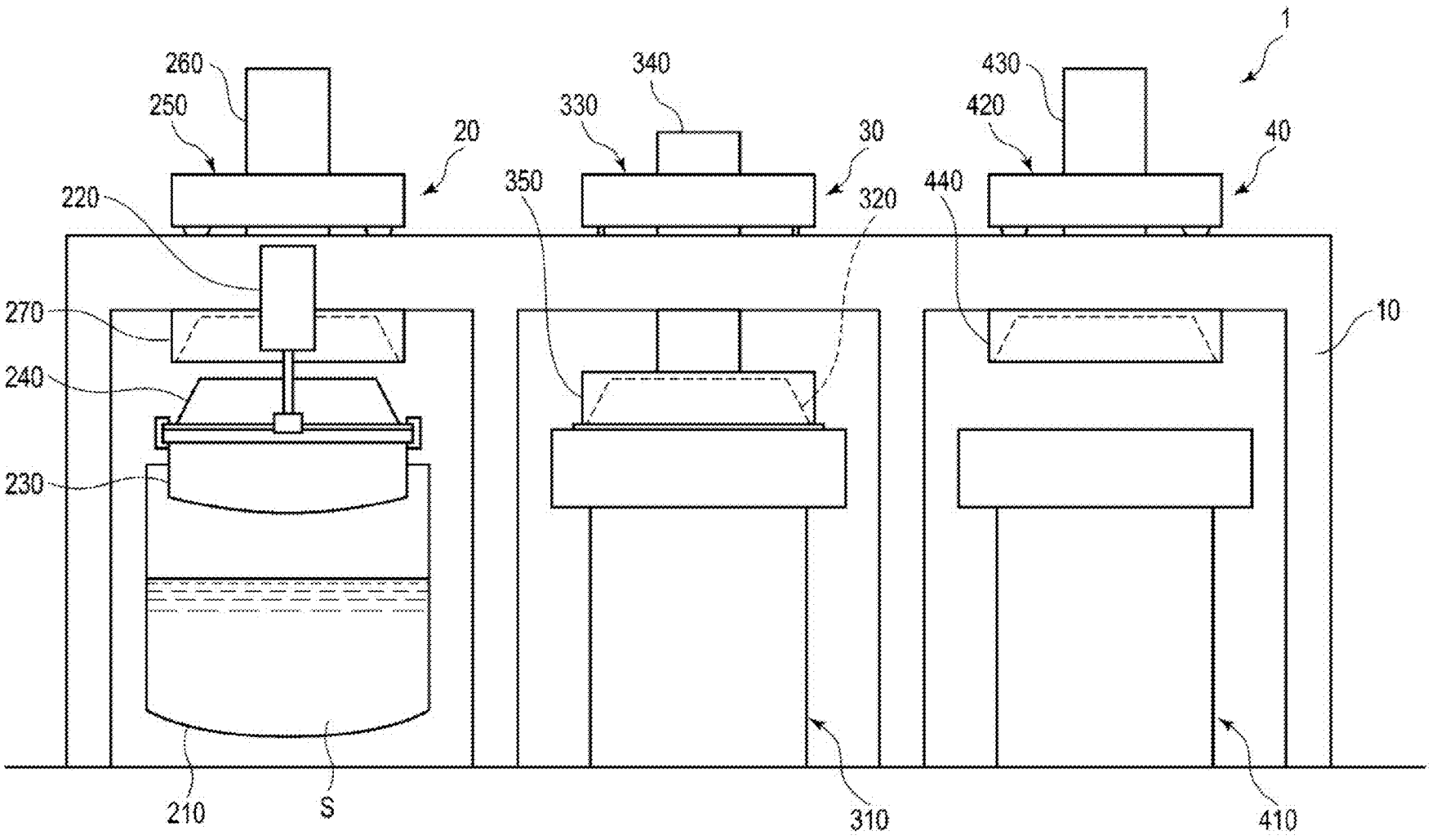
FIG. 7 is a view showing a hot press step in pulp molding using the device shown in FIG. 2.
Figure 8:
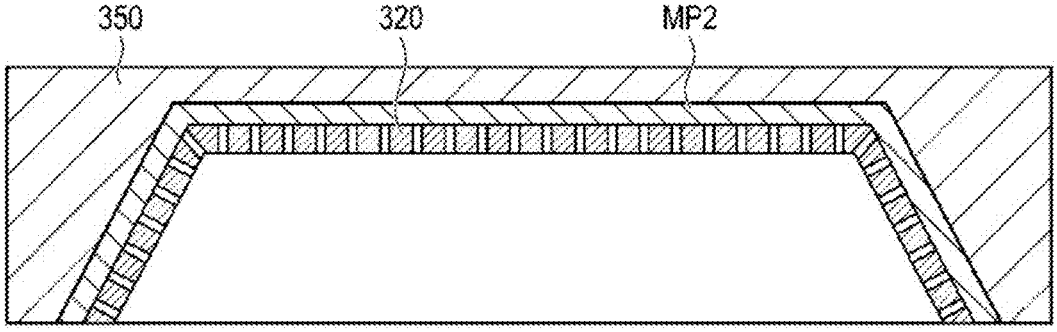
FIG. 8 is a cross-sectional view schematically showing an example of a molded pulp article obtained by a hot press step.
Figure 9:
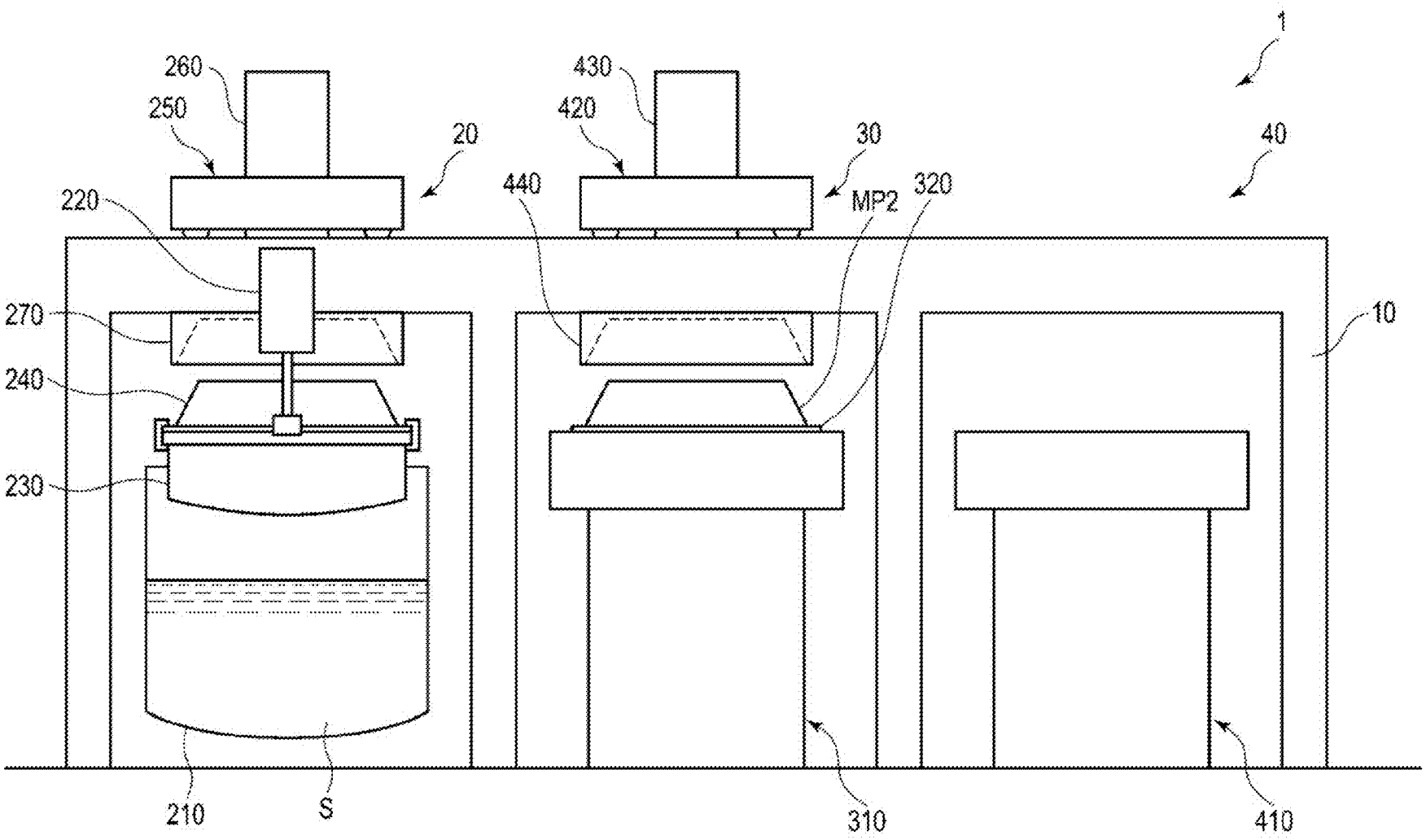
FIG. 9 is a view showing a molded pulp article transport step in pulp molding using the apparatus shown in FIG. 2.
Figure 10:
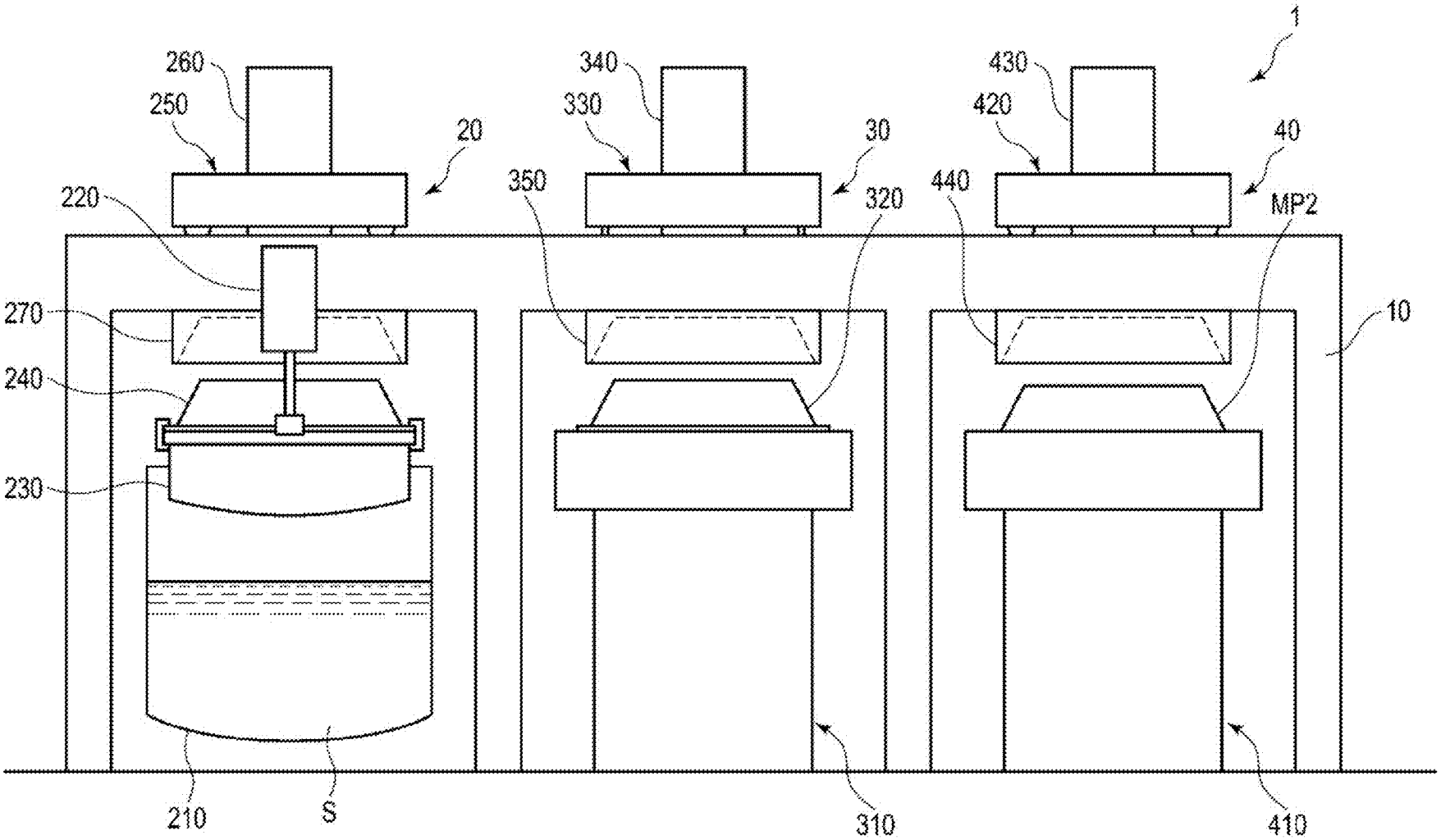
FIG. 10 is a view showing a state after completing the transport step of FIG. 9.

FIG. 3 is a view showing a pulp layer formation step in pulp molding using the apparatus shown in FIG. 2. FIG. 4 is a cross-sectional view schematically showing an example of the pulp layer formed on the paper-making mold. FIG. 5 is a view showing a dehydration step in pulp molding using the apparatus shown in FIG. 2. FIG. 6 is a view showing a pulp layer transport step in pulp molding using the apparatus shown in FIG. 2. FIG. 7 is a view showing a hot press step in pulp molding using the apparatus shown in FIG. 2. FIG. 8 is a cross-sectional view schematically showing an example of a molded pulp article obtained by a hot press step. FIG. 9 is a view showing a molded pulp article transport step in pulp molding using the apparatus shown in FIG. 2. FIG. 10 is a view showing a state after completing the transport step of FIG. 9.

In this method, first, a slurry S is prepared.

The slurry S contains pulp and water. The slurry S preferably further contains a paper strength enhancer. Here, as an example, the slurry S is a suspension with a high viscosity in which pulp is dispersed in a solution containing water and a paper strength enhancer.

In the pulp contained in the slurry S, the average fiber length is in the range described above for the pulp contained in the molded pulp article MP2. The pulp contained in the slurry S preferably further has one or more of the other features described above for the pulp contained in the molded pulp article MP2. More preferably, the pulp contained in the slurry S has substantially similar features to those described above for the pulp contained in the molded pulp article MP2.

The type of pulp used in the slurry S is not particularly limited. Examples of the pulp include wood pulp, non-wood pulp, and waste paper, and wood pulp and non-wood pulp are preferable. From the perspective of environmental considerations, such as forest conservation and utilization of unused resources, it is preferable to use non-wood pulp.

Pulps can be classified according to their preparation methods. Examples of wood pulp include chemical pulps, such as kraft pulp (KP), sulfite pulp (SP), and soda pulp (AP); semi-chemical pulps, such as semi-chemical pulp (SCP) and chem-groundwood pulp (CGP); groundwood pulp (GP), thermomechanical pulp (TMP), and the like. Among these, it is preferable to use chemical pulp.

Wood pulps can be classified according to the raw materials. Examples of wood pulps include softwood pulp and hardwood pulp. Examples of softwood pulp include pulp obtained from the genus *Abies, Pinus*, or the like. Further, examples of hardwood pulp include pulp obtained from the genus *Acacia, Eucalyptus, Beech, Populus* (e.g., poplar), or the like.

Non-wood pulp is obtained from fibers collected from the skin, stems, leaves, and leaf sheaths of plants. Specific examples include pulp obtained from cotton linter, cotton, linen, hemp, ramie, straw, esparto, Manila hemp, sisal hemp, jute, flax, kenaf, bamboo, sugarcane, ganpi, *Edgeworthia chrysantha*, paper mulberry, or mulberry. Preferred among these is pulp made from bamboo or sugarcane.

These pulps can be used singly or in a mixture of two or more at a preferred ratio.

Pulps have different fiber lengths depending on their raw materials and production methods. For example, in general, pulp made from sugarcane has a shorter average fiber length than pulp made from bamboo. Further, the average fiber length of pulp can be adjusted by an arbitrary method, for example, mechanical treatment such as beating or crushing. Therefore, pulp with certain characteristics can be obtained, for example, by selecting an appropriate one from multiple types of pulps, or by appropriately combining two or more types of pulps.

The pulp content of the slurry S is preferably in the range of 0.01 mass % to 3.0 mass %, and more preferably in the range of 0.01 mass % to 0.5 mass %. If the pulp content is low, it is difficult to achieve high productivity. If the pulp content is high, there may be a large variation in the thickness of the pulp layer.

The paper strength enhancer contained in the slurry S may be, for example, a compound containing nitrogen. The paper strength enhancer is preferably polyacrylamide.

The percentage of the paper strength enhancer in the solid content of the slurry S is preferably in the range of 0.1 mass % to 10 mass %, more preferably in the range of 0.1 mass % to 3.0 mass %, even more preferably in the range of 0.5 mass % to 3.0 mass %, still even more preferably in the range of 0.5 mass % to 2.0 mass %, and further more preferably in the range of 0.6 mass % to 1.5 mass %. The percentage of the paper strength enhancer in the solid content of the slurry S may be in the range of 0.8 mass % to 2.0 mass %. If this percentage is small, it is difficult to produce a molded pulp article MP2 having high strength. If this percentage is excessively increased, the pulp in the slurry may aggregate, resulting in uneven molded articles.

The slurry S may further contain additives other than the paper strength enhancer. Organic low-molecular-weight materials, organic high-molecular-weight materials, inorganic materials or combinations thereof can be used as additives, such as agents that impart water resistance and oil resistance, and the agent should be selected according to the required performance as a molded pulp container. The ratio of the total of the paper strength enhancer and additives to the total of the pulp, paper strength enhancer, and additives is preferably 10 mass % or less, and more preferably 5 mass % or less. That is, the percentage of the pulp in the total solid content of the slurry S is preferably 90 mass % or more, and more preferably 95 mass % or more.

Next, the slurry S is supplied into the container 210. Then, as shown in FIG. 3, the lifting device 220 lowers the cover body 230 to locate the top surface of the paper-making mold 240 well below the liquid level of the slurry S. In this state, the pump is driven to depressurize the space surrounded by the cover body 230 and the paper-making mold 240. In this manner, a flow of the slurry S is produced across the paper-making mold 240, and the pulp is deposited on the paper-making mold 240. As described above, a pulp layer MP1 is formed on the paper-making mold 240, as shown in FIG. 4.

Next, as shown in FIG. 5, while the pump is driven, the lifting device 220 raises the cover body 230 to locate the bottom of the paper-making mold 240 well above the liquid level of the slurry S. In this manner, the pulp layer MP1 is dehydrated under reduced pressure. Next, the lifting device 260 is driven to lower the upper mold 270 until its bottom surface comes into contact with the pulp layer MP1. The pulp layer MP1 is not shown in FIG. 5. The dehydration step is performed without heating either of the upper mold 270 or the paper-making mold 240.

The depressurization time in the dehydration step is preferably in the range of 1 to 60 seconds, and more preferably in the range of 1 to 10 seconds.

The water content of the pulp layer MP1 immediately after dehydration is preferably in the range of 40 mass % to 90 mass %, more preferably in the range of 50 mass % to 70 mass %, and further more preferably in the range of 50 mass % to 65 mass %. If the water content is small, in the hot pressing step, movement of fibers in the in-plane direction in the pulp layer may be insufficient. If the water content is large, in the hot pressing step, the movement of fibers in the in-plane direction within the pulp layer may be excessive, or the shape retention of the pulp layer MP1 may be insufficient during the period from the end of the dehydration step to the start of the hot pressing step.

After terminating the depressurization of the space and the pressurization, the pump is driven to allow the upper mold 270 to adsorb and hold the pulp layer MP1. Suction by the pump and the upper mold 270 does not cause further dehydration in the pulp layer MP1.

Then, while allowing the upper mold 270 to adsorb and hold the pulp layer MP1, the lifting device 260 is driven to raise the upper mold 270, as shown in FIG. 2. In this manner, the pulp layer MP1 is removed from the paper-making mold 240.

Next, the conveying devices 250 and 330 are driven to move the press device 340 and the upper mold 350 from the second station 30 to the fourth station, and the lifting device 260 and the upper mold 270 from the first station 20 to the second station 30, as shown in FIG. 6. Subsequently, the lifting device 260 is driven to lower the upper mold 270 until the pulp layer MP1 comes into contact with the lower mold 320. Thereafter, suction by the pump and the upper mold 270 is stopped to release the pulp layer MP1 from the upper mold 270. Then, the lifting device 260 is driven to raise the upper mold 270. In this manner, the pulp layer MP1 is transported from the first station 20 to the second station 30, and the pulp layer MP1 is placed on the lower mold 320.

Next, the conveying devices 250 and 330 are driven to move the lifting device 260 and the upper mold 270 from the second station 30 to the first station 20, and the press device 340 and the upper mold 350 from the fourth station to the second station 30, as shown in FIG. 2. Subsequently, the press device 340 is driven to lower the upper mold 350, as shown in FIG. 7. Then, the upper mold 350 and the lower mold 320 pressurize the pulp layer MP1 held between them. Moreover, together with this, the heater is driven to heat the pulp layer MP1. Further, together with this, the pump is driven to suction and remove water and/or water vapor from the space sandwiched between the upper mold 350 and the lower mold 320. In this manner, the surface shape of the pulp layer MP1 is adjusted, and the pulp layer MP1 is densified and dried. As described above, a molded pulp article MP2 shown in FIG. 8 is obtained.

The water content of the pulp layer MP1 immediately before the start of the hot pressing step is almost equal to the water content of the pulp layer MP1 immediately after the end of the dehydration step.

In the hot pressing step, the press pressure is preferably in the range of 0.6 MPa to 6.0 MPa, and more preferably in the range of 1.0 MPa to 6.0 MPa. If the press pressure is lower, a molded pulp article MP2 having a high strength may not be obtained. The press pressure may be in the range of 1.0 MPa to 3.0 MPa.

In the hot pressing step, the heating temperature of the pulp layer MP1, that is, the temperature of the upper mold 350 or lower mold 320 heated by the heater, is preferably in the range of 130° C. to 200° C., and more preferably in the range of 150° C. to 185° C. Since the pulp layer MP1 contains a large amount of pulp with a long fiber length, water vapor easily escapes to the outside. Therefore, even if the heating temperature is low, drying of the pulp layer MP1 can be completed in a short time. If the heating temperature is increased, the shrinkage of the pulp layer MP1 due to drying becomes larger, and as a result, distortions in the molded pulp article MP2 may be larger.

The press time in the hot pressing step depends on the heating temperature, the shape of the molded article, and the like, but is preferably in the range of 10 to 140 seconds, and more preferably in the range of 20 to 120 seconds.

Upon finishing the above hot pressing step, when the press device 340 is driven to raise the upper mold 350, the molded pulp article MP2 is removed from the upper mold 350.

Next, the conveying devices 330 and 420 are driven to move the press device 340 and the upper mold 350 from the second station 30 to the fourth station, and the lifting device 430 and the holder 440 from the third station 40 to the second station 30, as shown in FIG. 9. Subsequently, the lifting device 430 is driven to lower the holder 440 until the holder 440 comes into contact with the molded pulp article MP2. Air is blown from the inside of the lower mold to release the molded pulp article MP2 from the lower mold, and the pump is then driven to allow the holder 440 to suction and hold the molded pulp article MP2.

Then, while allowing the holder 440 to suction and hold the molded pulp article MP2, the lifting device 430 is driven to raise the holder 440. Subsequently, the conveying devices 330 and 420 are driven to move the lifting device 430 and the holder 440 from the second station 30 to the third station 40, and the press device 340 and the upper mold 350 from the fourth station to the second station 30, as shown in FIG. 10. Subsequently, suction by the pump and the holder 440 is stopped to release the molded pulp article MP2 from the holder 440. In this manner, the pulp the molded article MP2 is transported from the second station 30 to the third station 40, and the molded pulp article MP2 is placed on the stand 410.

As described above, the molded pulp article MP2 is produced.

Thereafter, the molded pulp article MP2 is subjected to post-treatment, for example, printing such as picture printing and plain printing, coating, or a combination thereof, as necessary. The coating layer formed by post-treatment may be, for example, a layer containing a chemical agent that imparts water resistance or oil resistance, a layer filled with a material that imparts heat insulation properties, a layer foamed with a foaming agent, or a combination thereof. Performing the post treatment can, for example, further enhance the decorative properties of the molded pulp article MP2 or impart new functions to the molded pulp article MP2.

The above method can produce a molded pulp article MP2 that allows drying to be completed in a short time, and that has a high strength.

Moreover, the molded pulp article MP2 obtained by the above method has excellent surface properties. The reason for this will be explained below.

When drying using an oven is performed in place of the hot pressing step, the surface of the pulp layer becomes uneven with large height differences due to its contraction. Further, in such a method, the pulp layer is not sufficiently densified, and thus the molded pulp article has high porosity. Therefore, in this case, a molded pulp article with excellent surface properties cannot be produced.

Further, when the dehydration step is followed by drying the product with an oven, humidifying the dried product as necessary, and performing a hot pressing treatment on this product, height differences due to unevenness formed on the surface due to drying can be reduced by the subsequent humidification and hot pressing treatment. The porosity can also be reduced by the humidification and hot pressing treatment. However, the height differences of the unevenness formed on the surface due to drying using an oven are very large, and thus cannot be sufficiently reduced by the subsequent humidification and hot pressing treatment. Further, even when drying is followed by humidification and hot pressing treatment, it is difficult to sufficiently decrease the porosity.

In the method explained with reference to FIG. 2 to FIG. 10, the pulp layer MP1 is dried in the hot pressing step. That is, in the above method, the hot pressing step is performed after the dehydration step without a drying step. As the pulp, one having an average fiber length within the above range is used.

Since the drying step is not performed before the hot pressing step, unevenness with a large height difference does not occur on the surface of the pulp layer MP1. In the hot pressing step, deformation of the pulp layer MP1 due to drying is prevented by the upper mold 350 and the lower mold 320. Further, since the hot pressing step is performed on the pulp layer MP1, which has a high water content and whose pulp has an average fiber length within the above-described range, only moderate movement of fibers in the in-plane direction can occur within the pulp layer MP1. The pulp layer MP1 can be densified without causing variation in thickness.

Therefore, the method explained with reference to FIG. 2 to FIG. 10 can produce a molded pulp article MP2 having excellent surface properties. Specifically, a molded pulp article MP2 can be obtained having, on the surface, a region in which one or more of arithmetic mean roughness Ra, maximum height roughness Rz, and average length of roughness curve elements RSm are small. The molded pulp article MP2 has excellent decorative properties, and printing and coating layers are easy to form.

The arithmetic mean roughness Ra is preferably in the range of 2 μm to 10 μm, and more preferably in the range of 3 μm to 4.5 μm. The maximum height roughness Rz is preferably in the range of 10 μm to 60 μm, and more preferably in the range of 20 μm to 35 μm. The average length of roughness curve elements RSm is preferably in the range of 90 μm to 300 μm, more preferably in the range of 90 μm to 150 μm, and further more preferably in the range of 90 μm to 130 μm.

Here, the "arithmetic mean roughness Ra," "maximum height roughness Rz," and "average length of roughness curve elements RSm" are surface properties parameters specified in JIS B 0601: 2001. The surface properties parameters are measured using, for example, a Surface Roughness Meter SJ-210 (tip radius: 2 μm, measuring force: 0.75 mN) produced by Mitutoyo Corporation, under the following conditions.

Filter: Gaussian

Cut off λc: 0.25 mm

Cut off λs: 8 μm

Measurement speed: 0.25 mm/s

Number of sections: 5

A plate-shaped piece is taken from the molded pulp article MP2, measurements are performed at five arbitrary locations, and the average value is calculated.

In the molded pulp article MP2, the entire surface may have the above-described surface properties, or only some areas of the surface may have the above-described surface properties. For example, only areas including the part to undergo post-treatment, such as printing, may have the above surface properties, and the other areas may not have the above surface properties. Alternatively, one surface of the molded pulp article MP2 may have the above surface properties, and the back surface may not have the above surface properties. Such a structure can be achieved by, for example, allowing the surface properties to differ between a partial area and the other areas of the surface of each of the upper mold 350 and lower mold 320 in contact with the pulp layer MP1.

Moreover, the method explained with reference to FIG. 2 to FIG. 10 can produce a molded pulp article MP2 having a low standard deviation of basis weight. The standard deviation of basis weight of the molded pulp article MP2 is preferably 30 g/m$^2$ or less, and more preferably 15 g/m$^2$ or less. The lower limit value of the standard deviation is zero, and may be, for example, 2 g/m$^2$.

The standard deviation of basis weight of the molded pulp article MP2 is a value obtained by the following method.

First, nine strip-shaped samples with a width of 15 mm and a length of 40 mm are cut out from multiple regions located within a certain plane of the molded pulp article MP2. Next, the mass of these samples is measured. Thereafter, the basis weight of each sample is calculated from its mass and area (600 mm$^2$). The standard deviation is calculated from the thus-obtained basis weight.

Next, nine samples are cut out from multiple regions located within a different plane of the molded pulp article MP2 in the same manner as described above. The mass of these samples is also measured, and the basis weight and its standard deviation are calculated.

If the molded pulp article MP2 further has other surfaces, for each of the other surfaces, samples are cut out, and the mass measurement and the calculation of basis weight and its standard deviation are performed in the same manner as described above.

Then, the maximum value of these standard deviations is taken as the standard deviation of basis weight of the molded pulp article MP2.

The present inventors consider that the reason why the molded pulp article MP2 with a low standard deviation of basis weight can be produced by the method explained with reference to FIG. 2 to FIG. 10 (hereinafter referred to as the first method) is as follows.

The molded pulp article can also be produced, for example, by the method described below (hereinafter referred to as a second method).

In the second method, first, a female mold is prepared as a paper-making mold. The paper-making mold is provided with many through holes, and includes a paper-making mold body having a top surface with a recessed shape corresponding to the molded pulp article, and a net body provided on and across the inner surface of the paper-making mold body.

Next, the paper-making mold is placed so that its opening faces upward. Then, a slurry containing pulp and water is supplied into the cavity of the paper-making mold, and the inside of the paper-making mold is filled with the slurry. Further, supplying the slurry into the paper-making mold is continued to deposit the pulp on the net body. The slurry is supplied into the paper-making mold so that the slurry inside the paper-making mold is under pressure.

After a sufficient amount of pulp has been deposited on the net body, supplying the slurry into the paper-making mold is stopped. Subsequently, the water remaining in the paper-making mold is discharged from the paper-making mold. For example, air is compressed into the paper-making mold to discharge the water remaining in the paper-making mold from the paper-making mold.

Next, the paper-making mold and the upper mold, which is a male mold, press the pulp layer to dehydrate the pulp layer. The dehydration step is performed without heating either of the upper mold or the paper-making mold. The water content of the pulp layer immediately after dehydration is the same as the water content of the pulp layer MP1 immediately after dehydration in the first method.

Then, the upper mold is allowed to suction and hold the pulp layer, and the upper mold is raised in this state. In this manner, the pulp layer is removed from the paper-making mold.

Next, the upper mold, which suctions and holds the pulp layer, is moved to the position of the lower mold, which is a female mold. Subsequently, the upper mold is lowered until the pulp layer comes into contact with the lower mold. Thereafter, suction is stopped to release the pulp layer from the upper mold. In this manner, the pulp layer is placed on the lower mold.

Next, the pulp layer is held between upper and lower molds for hot pressing, and the pulp layer between them is pressurized. Moreover, together with this, the heater is driven to heat the pulp layer. Further, together with this, the pump is driven to suction and remove water and/or water vapor from the space sandwiched between the upper mold and the lower mold. In the second method, a molded pulp article is obtained as described above.

In the second method, during the period from the start of supplying the slurry into the paper-making mold until the inside of the paper-making mold is completely filled with the slurry, a flow of the slurry to circulate within the paper-making mold can be generated. This circulating flow can prevent the pulp from settling. However, in the second method, it is necessary to fill the paper-making mold with the slurry; thus, a structure that discharges water quickly cannot be adopted for the paper-making mold. Therefore, after the inside of the paper-making mold is completely filled with the slurry, even if the pressure of the slurry is increased, a circulating flow of the slurry sufficient to prevent the pulp from settling is not generated, and the pulp settles in the slurry inside the paper-making mold.

As a result, the amount of pulp deposited on the sidewall of the paper-making mold is greater in the lower part than in the upper part. If the slurry is supplied until a sufficient amount of pulp is deposited above the sidewall of the paper-making mold, an excessive amount of pulp will be deposited in the bottom of the paper-making mold. If an excessive amount of pulp is deposited, the variation in the amount of pulp deposited will increase. For example, there can be a large difference in the amount of pulp deposited near the through holes provided in the paper-making mold body and at locations further from them.

Thus, in the second method, a large variation occurs in the amount of pulp deposited. During hot pressing treatment, fibers can move in the in-plane direction within the pulp layer; however, the movement of each fiber is restricted to a narrow range. That is, variation in the amount of pulp deposited cannot be eliminated by the movement of fibers during hot pressing treatment. Therefore, the second method cannot produce a molded pulp article with a low standard deviation of basis weight.

In contrast, in the first method, the paper-making mold 240 is provided above the cover body 230, and the combination thereof is immersed in the slurry S. The depth of the slurry S is much greater than the height of the paper-making mold 240. Therefore, even if the pulp settles in the slurry S, the pulp concentration does not differ greatly between upper positions in the paper-making mold 240 and lower position in the paper-making mold 240. Therefore, according to the first method, pulp can be substantially uniformly deposited on the paper-making mold 240, and thus a molded pulp article MP2 having only a small standard deviation of basis weight can be produced.

The molded pulp article MP2 has an opening, the diameter of which does not expand in a direction away from the opening. Here, the molded pulp article MP2 has an opening which tapers in a direction away from the opening. This shape makes it possible to reduce the volume of a stack of a plurality of molded pulp articles MP2.

In the first method, when the pulp layer MP1 held between one of the upper mold 350 and the lower mold 320 and an elastic body is pressurized, instead of pressurizing the pulp layer MP1 by the upper mold 350 and the lower mold 320, the elastic body is deformed. Therefore, not enough pressure is applied to the pulp layer MP1, and a molded pulp article with excellent surface properties cannot be obtained.

In the second method as well, when one of the upper and lower molds used for the hot pressing treatment is changed to an elastic body, a molded pulp article with excellent surface properties cannot be obtained. In this case, the standard deviation of basis weight increases, as described above.

The molded pulp article MP2 may be, for example, a container. The molded pulp article MP2 may be an article other than containers. The molded pulp article MP2 may be a three-dimensional molded article, that is, a molded article having a three-dimensional shape rather than an article having a two-dimensional shape, such as a sheet.

FIG. 2 to FIG. 10 are intended to facilitate the understanding of the method for producing a molded pulp article according to an embodiment of the present invention. The methods described above can also be performed using production apparatuses having other structures. For example, in the production apparatus 1, the upper mold 270 and the upper mold 350 are female molds, and the paper-making mold 240 and the lower mold 320 are male molds. The upper mold 270 and the upper mold 350 may be male molds, and the paper-making mold 240 and the lower mold 320 may be female molds. Thus, the production apparatus 1 and production method described above can be modified in various ways.

EXAMPLES

Specific examples of the present invention will be described below. The present invention is not limited to any of these specific examples.

<1> Production of Molded Pulp Article

Example 1

Using a pulper, a slurry composed of pulp, water, and a paper strength enhancer was prepared. The pulp content of the slurry was 0.3 mass %. Pulp A used was pulp made from bamboo and having an average fiber length of 1.6 mm. The paper strength enhancer used was Polystron (registered trademark) 1280 produced by Arakawa Chemical Industries, Ltd. The percentage of the paper strength enhancer in the solid content of the slurry was 1.0 mass %.

Using this slurry, a molded pulp article was produced by the method explained with reference to FIG. 2 to FIG. 10. Here, the dehydration step was performed so that the water content of the pulp layer immediately after dehydration was 65 mass %. The hot pressing step was performed at a heating temperature of 180° C., a press pressure of 1.5 MPa, and a press time of 100 seconds. In the dehydration step and the hot pressing step, the clearance between the upper and lower molds was 1.3 mm so that a molded pulp article with a wall thickness of 1.3 mm was obtained. In Examples 1 to 9 and Comparative Examples 1 to 5, the press time (drying time) was determined so that sufficient drying was reliably performed in the shortest possible time.

As described above, a container was produced as a molded pulp article.

Example 2

A molded pulp article was produced in the same manner as in Example 1, except that the amount of pulp deposited on the paper-making mold 240 was increased.

Example 3

A molded pulp article was produced in the same manner as in Example 1, except that the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 90 seconds.

Example 4

A molded pulp article was produced in the same manner as in Example 1, except that the percentage of the paper strength enhancer in the solid content of the slurry was changed to 1.5 mass %, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 90 seconds.

Example 5

A molded pulp article was produced in the same manner as in Example 1, except that the percentage of the paper strength enhancer in the solid content of the slurry was changed to 3.0 mass %, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 90 seconds.

Example 6

A molded pulp article was produced in the same manner as in Example 1, except that the percentage of the paper strength enhancer in the solid content of the slurry was changed to 0.5 mass %, and the amount of pulp deposited on the paper-making mold 240 was increased.

Example 7

A molded pulp article was produced in the same manner as in Example 1, except that the percentage of the paper strength enhancer in the solid content of the slurry was changed to 0.3 mass %, and in the dehydration step and the hot pressing step, the clearance between the upper and lower molds was changed to 1.0 mm so that a molded pulp article with a wall thickness of 1.0 mm was obtained, and the press time was changed to 90 seconds.

Example 8

A molded pulp article was produced in the same manner as in Example 1, except that a combination of pulp A and pulp B with an average fiber length of 0.9 mm was used instead of using pulp A as pulp, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 90 seconds. Here, the amount of pulp A was 90 parts by mass, and the amount of pulp B was 10 parts by mass, relative to 100 parts by mass of the total amount of pulp.

Example 9

A molded pulp article was produced in the same manner as in Example 1, except that pulp C with an average fiber length of 2.3 mm was used instead of using pulp A as pulp, the amount of pulp deposited on the paper-making mold 240 was increased, and in the dehydration step and the hot pressing step, the clearance between the upper and lower molds was changed to 0.9 mm so that a molded pulp article with a wall thickness of 0.9 mm was obtained, and the press time was changed to 90 seconds.

Comparative Example 1

A molded pulp article was produced in the same manner as in Example 1, except that the paper strength enhancer was omitted.

Comparative Example 2

A molded pulp article was produced in the same manner as in Example 1, except that a combination of pulp A and pulp B was used instead of using pulp A as pulp, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 150 seconds. Here, the amount of pulp A was 70 parts by mass, and the amount of pulp B was 30 parts by mass, relative to 100 parts by mass of the total amount of pulp.

Comparative Example 3

A molded pulp article was produced in the same manner as in Example 1, except that a combination of pulp A and pulp B was used instead of using pulp A as pulp, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 170 seconds. Here, the amount of pulp A was 50 parts by mass, and the amount of pulp B was 50 parts by mass, relative to 100 parts by mass of the total amount of pulp.

Comparative Example 4

A molded pulp article was produced in the same manner as in Example 1, except that pulp B was used instead of using pulp A as the pulp, the amount of pulp deposited on the paper-making mold 240 was increased, and in the dehydration step and the hot pressing step, the clearance between the upper and lower molds was changed to 1.0 mm so that a molded pulp article with a wall thickness of 1.0 mm was obtained, and the press time was changed to 210 seconds.

Comparative Example 5

A molded pulp article was produced in the same manner as in Example 1, except that the amount of pulp deposited on the paper-making mold 240 was reduced, and in the dehydration step and the hot pressing step, the clearance between the upper and lower molds was changed to 0.7 mm so that a molded pulp article with a wall thickness of 0.7 mm was obtained, and the press time was changed to 70 seconds.

<2> Evaluation

The molded pulp articles produced in Examples 1 to 9 and Comparative Examples 1 to 5 were subjected to various measurements by the methods described above. Tables 1 and 2 below show the results.

TABLE 1

| | Example 1 | Example 2 | Example 3 | Example 4 | Example 5 | Example 6 | Example 7 |
|---|---|---|---|---|---|---|---|
| Pulp A (parts by mass) | 100 | 100 | 100 | 100 | 100 | 100 | 100 |
| Pulp B (parts by mass) | 0 | 0 | 0 | 0 | 0 | 0 | 0 |
| Pulp C (parts by mass) | 0 | 0 | 0 | 0 | 0 | 0 | 0 |

TABLE 1-continued

| | Example 1 | Example 2 | Example 3 | Example 4 | Example 5 | Example 6 | Example 7 |
|---|---|---|---|---|---|---|---|
| Paper strength enhancer (solid content; mass %) | 1.0 | 1.0 | 1.0 | 1.5 | 3.0 | 0.5 | 0.3 |
| Nitrogen content (μg/g) | 710 | 710 | 710 | 97 | 1750 | 450 | 345 |
| Average fiber length (mm) | 1.6 | 1.6 | 1.6 | 1.6 | 1.6 | 1.6 | 1.6 |
| Percentage of short fibers (%) | 30 | 30 | 30 | 30 | 30 | 30 | 32 |
| Length/width | 92 | 92 | 92 | 92 | 92 | 92 | 91 |
| Canadian Standard Freeness (mL) | 670 | 670 | 670 | 670 | 670 | 670 | 670 |
| Thickness (mm) | 1.3 | 1.3 | 1.0 | 1.0 | 1.0 | 1.3 | 1.0 |
| Drying time (sec) | 100 | 100 | 90 | 90 | 90 | 100 | 90 |
| Flexural modulus (MPa) | 1202 | 1708 | 2770 | 2930 | 3258 | 2234 | 1571 |
| Tensile strength (kN/m) | 23.6 | 28.8 | 44 | 50.0 | 63.9 | 28.0 | 25.0 |
| Density (g/cm$^3$) | 0.63 | 0.7 | 1.0 | 1.1 | 1.1 | 0.84 | 0.83 |

TABLE 2

| | Example 8 | Example 9 | Comparative Example 1 | Comparative Example 2 | Comparative Example 3 | Comparative Example 4 | Comparative Example 5 |
|---|---|---|---|---|---|---|---|
| Pulp A (parts by mass) | 90 | 0 | 100 | 70 | 50 | 0 | 100 |
| Pulp B (parts by mass) | 10 | 0 | 0 | 30 | 50 | 100 | 0 |
| Pulp C (parts by mass) | 0 | 100 | 0 | 0 | 0 | 0 | 0 |
| Paper strength enhancer (solid content; mass %) | 1.0 | 1.0 | 0 | 1.0 | 1.0 | 1.0 | 1.0 |
| Nitrogen content (μg/g) | 750 | 600 | 190 | 780 | 850 | 900 | 710 |
| Average fiber length (mm) | 1.5 | 2.3 | 1.6 | 1.4 | 1.3 | 0.9 | 1.6 |
| Percentage of short fibers (%) | 34 | 17 | 28 | 41 | 48 | 66 | 30 |
| Length/width | 85 | 80 | 92 | 73 | 61 | 38 | 92 |
| Canadian Standard Freeness (mL) | 654 | 675 | 667 | 598 | 539 | 393 | 670 |
| Thickness (mm) | 1.0 | 0.9 | 1.3 | 1.0 | 1.0 | 1.0 | 0.7 |
| Drying time (sec) | 90 | 90 | 100 | 150 | 170 | 210 | 70 |
| Flexural modulus (MPa) | 2406 | 2697 | 1491 | 2637 | 2500 | N.D. | 892 |
| Tensile strength (kN/m) | 47.1 | 55.2 | 19.2 | 40 | 38 | N.D. | 26.5 |
| Density (g/cm$^3$) | 1.0 | 0.93 | 0.62 | 0.92 | 0.84 | N.D. | 0.64 |

In Tables 1 and 2, "Percentage of short fibers" represents the percentage of fibers having a fiber length of 1 mm or less in the pulp. Further, in Tables 1 and 2, "Length/width" represents the average ratio L/W of fiber length L and fiber width W.

As is clear from a comparison between Examples 1 to 9 and Comparative Examples 1 to 5, molded pulp articles that were produced to have a thickness within a predetermined range using a slurry in which the average fiber length of pulp was within a predetermined range, the percentage of fibers having a fiber length of 1 mm or less in the pulp was within a predetermined range, and a paper strength enhancer was contained in an amount within a predetermined range, could be produced with a sufficiently short press time and had high strength. In all of the molded pulp articles of Examples 1 to 9, the arithmetic mean roughness Ra was in the range of 2 μm to 10 μm, the maximum height roughness Rz was in the range of 10 μm to 60 μm, and the average length of roughness curve elements RSm was in the range of 90 μm to 300 μm.

[Reference Signs List] 1 . . . Production apparatus; 10 . . . Support; 20 . . . First station; 30 . . . Second station; 40 . . . Third station; 210 . . . Container; 220 . . . Lifting device; 230 . . . Cover body; 240 . . . Paper-making mold; 250 . . . Conveying device; 260 . . . Lifting device; 270 . . . Upper mold; 310 . . . Stand; 320 . . . Lower mold; 330 . . . Conveying device; 340 . . . Press device; 350 . . . Upper mold; 410 . . . Stand; 420 . . . Conveying device; 430 . . . Lifting device; 440 . . . Holder; MP1 . . . Pulp layer; MP2 . . . Molded pulp article; S . . . Slurry.

What is claimed is:

1. A molded pulp article, comprising:

a pulp, wherein fibers having a fiber length of 1 mm or less constitute 15% to 35% of a total number of fibers in the pulp, the fibers in the pulp have an average fiber length from 1.5 mm to 2.5 mm, the molded pulp article has a nitrogen content from 200 μg/g to 1800 μg/g, and the molded pulp article has a thickness from 0.8 mm to 2.0 mm.

2. The molded pulp article of claim 1, wherein the fibers having a fiber length of 1 mm or less constitute 25% to 34% of a total number of fibers in the pulp, the molded pulp article has the nitrogen content from 300 μg/g to 1,000 μg/g, and the molded pulp article has the thickness from 1 mm to 1.5 mm.

3. The molded pulp article of claim 1, wherein the molded pulp article has a density from 0.6 g/cm3 to 1.2 g/cm$^3$.

4. The molded pulp article of claim 1, wherein the molded pulp article has a flexural modulus from 1,000 MPa to 3,500 MPa.

5. The molded pulp article of claim 1, wherein the molded pulp article has a tensile strength from 20 kN/m to 65 kN/m.

6. The molded pulp article of claim 1, wherein an average ratio of a fiber length to a fiber width among the fibers in the pulp is from 80 to 95.

7. The molded pulp article of claim 1, wherein the molded pulp article has a standard deviation of basis weight from 2 g/m$^2$ to 45 g/m$^2$.

8. The molded pulp article of claim 1, wherein the molded pulp article is a container.

9. The molded pulp article of claim 1, wherein the pulp is wood pulp.

10. The molded pulp article of claim 1, wherein the pulp is a non-wood pulp from skin, stems, leaves, or leaf sheaths of plants.

11. The molded pulp article of claim 1, wherein the pulp is a pulp obtained from cotton linter, cotton, linen, hemp, ramie, straw, esparto, Manila hemp, sisal hemp, jute, flax, kenaf, bamboo, sugarcane, ganpi, *Edgeworthia chrysantha*, paper mulberry, or mulberry.

12. The molded pulp article of claim 1, wherein the pulp is a pulp made from bamboo or sugarcane.

13. A method for producing a molded pulp article, the method comprising the steps of:

preparing a slurry containing pulp and water, fibers in the pulp having an average fiber length from 1.5 mm to 2.5 mm;

depositing the pulp on a paper-making mold having a three-dimensional shape to form a pulp layer;

dehydrating the pulp layer to obtain an intermediate molded article, wherein said dehydrating comprises depressurizing the pulp layer; and holding the undried intermediate molded article between male and female molds, and heating the intermediate molded article to a temperature from 130° C. to 200° C. while applying pressure from 0.6 MPa to 6.0 MPa.

14. The method for producing a molded pulp article of claim 13, wherein depositing the pulp on the paper-making mold comprises:

preparing a cover body as a hollow body having an opening;

fixing the paper-making mold to the opening;

immersing the paper-making mold fixed to the opening in the slurry; and depressurizing a space surrounded by the cover body and the paper-making mold immersed in the slurry.

15. The method for producing a molded pulp article of claim 14, wherein the paper-making mold is immersed in the slurry so that the paper-making mold is positioned above the cover body.

16. The method for producing a molded pulp article of claim 13, wherein the slurry further contains a paper strength enhancer, the percentage of the paper strength enhancer in the solid content of the slurry is from 0.2 mass % to 3 mass %, fibers having a fiber length of 1 mm or less constitute 25% to 34% of a total number of the fibers in the pulp, and the pressurization of the undried intermediate molded article held between the male and female molds is performed at a pressure from 1.0 MPa to 3.0 MPa.

17. The method for producing a molded pulp article of claim 13, wherein the dehydrating is performed without heating the paper-making mold.

18. The method for producing a molded pulp article of claim 13, wherein a water content of the pulp layer immediately after the dehydrating is from 50 mass % to 65 mass %.

19. The method for producing a molded pulp article of claim 13, wherein a time of said depressurizing is from 1 second to 10 seconds.

20. The molded pulp article of claim 1, wherein the fibers in the pulp are natural fibers.

* * * * *